US007410391B2

(12) United States Patent
Wan et al.

(10) Patent No.: US 7,410,391 B2
(45) Date of Patent: Aug. 12, 2008

(54) STACKED ELECTRICAL CONNECTOR ASSEMBLY WITH STABLE MATING CHARACTERISTIC

(75) Inventors: Feng Wan, Kunshan (CN); Jin-Kui Hu, Kunshan (CN); Guo-Hua Zhang, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/786,227

(22) Filed: Apr. 11, 2007

(65) Prior Publication Data

US 2007/0243757 A1 Oct. 18, 2007

(51) Int. Cl.
*H01R 13/648* (2006.01)

(52) U.S. Cl. ..... 439/607; 439/541.5

(58) Field of Classification Search ..... 439/541.5, 439/607

See application file for complete search history.

(56) References Cited

U.S. PATENT DOCUMENTS 6,540,563 B1 4/2003 Hu et al.
2005/0255745 A1* 11/2005 Walker et al. ..... 439/541.5

* cited by examiner

*Primary Examiner*—Ross N Gushi
(74) *Attorney, Agent, or Firm*—Wei Te Chung

(57) ABSTRACT

An electrical connector assembly (100) mounted on a printed circuit board (PCB) includes an insulative housing (1) defining a pair of stacked receiving cavities (15, 16) for receiving a first and a second connector components (2, 3) therein, a holder (4) attached to the insulative housing and a metal shield enclosing the insulative housing. The holder (4) is fixed to a rear wall (14) of the insulative housing (1) and includes a vertical mating portion (41) and a pair of top and bottom portions (42, 43) extending backwardly from the mating portion. The top and bottom portions (42, 43) are parallel to each other wherein the top portion (42) is shorter than the bottom portion (43). An area of the top portion is smaller than that of the bottom portion.

19 Claims, 5 Drawing Sheets

STACKED ELECTRICAL CONNECTOR ASSEMBLY WITH STABLE MATING CHARACTERISTIC

BACKGROUND OF THE INVENTION

1. Field of the Invention

This invention generally relates to a stacked electrical connector assembly, and more particularly to a stacked electrical connector assembly mounted on a printed circuit board (PCB) to mate with corresponding plugs.

2. Description of the Prior Art

A computer is required to provide connectors mounted on a PCB at input/output ports to mate with corresponding connectors of peripheral devices for signal transmission therebetween. In order to sufficiently utilize limited area of the PCB, the electrical connectors are usually arranged in a stacked manner. U.S. Pat. No. 6,540,563 B1 discloses such an electrical connector assembly comprising an insulative housing, a pair of upper and lower connectors vertically stacked in the insulative housing, a spacer connected to the insulative housing, and a board mounting surface on a lower portion thereof. The spacer is attached to a rear face of the insulative housing to form a combination in cubic-shaped configuration. A top and a bottom faces of the combination are of the same length and the same area so that the bottom face lacks of necessary retaining force. Besides, the upper connector is so high relative to the mounting surface that the electrical connector assembly is easy to incline when the corresponding connectors are inserted into or pulled out therefrom. As a result, the electrical connection between the electrical connector assembly and the PCB is unreliable, and the quality of signal transmission therebetween may be adversely affected.

Hence, it is desired to have an electrical connector assembly solving the problem above.

BRIEF SUMMARY OF THE INVENTION

Accordingly, an object of the present invention is to provide a stacked electrical connector assembly which can be stably mounted on a PCB to mate with corresponding plugs.

Another object of the present invention is to provide an electrical connector assembly with an improved holder which can be conveniently secured to an insulative housing of the electrical connector assembly.

In order to attain the objects above, an electrical connector assembly mounted on a PCB comprises an insulative housing, a first and a second connector components, a holder fixed to the insulative housing, a spacer and a metal shield enclosing the insulative housing. The insulative housing includes a front wall, a rear wall opposite to the front wall, a top wall and a mounting wall connecting the front and the rear walls. The front wall defines a first and a second receiving cavities stacked in a vertical direction to receive the first and the second connector components. The holder comprises a mating portion fixed to the rear wall of the insulative housing, and a top and a bottom portions respectively extending backwardly from an upper and a lower edges the mating portion. The top and bottom portions are parallel to each other and perpendicular to the mating portion. The bottom portion extends beyond the rear wall of the insulative housing. The top portion is shorter than the bottom portion and an area of the top portion is smaller than that of the bottom portion. The spacer is attached to the mounting wall of the insulative housing and the bottom portion of the holder for abutting against the PCB. The spacer comprises a front edge reaching the front wall of the insulative housing and a rear tail reaching a back of the bottom portion. The metal shield comprises a mating wall and a pair of side walls extending from lateral edges of the mating wall. Each side wall is trapezia shaped wherein a top edge of the side wall is shorter than a bottom edge thereof. The bottom portion extending beyond the rear wall of the insulative housing can provide stable retaining force for preventing the electrical connector assembly from inclining when the corresponding plug is inserted into or pulled out therefrom, especially from the first connector component.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
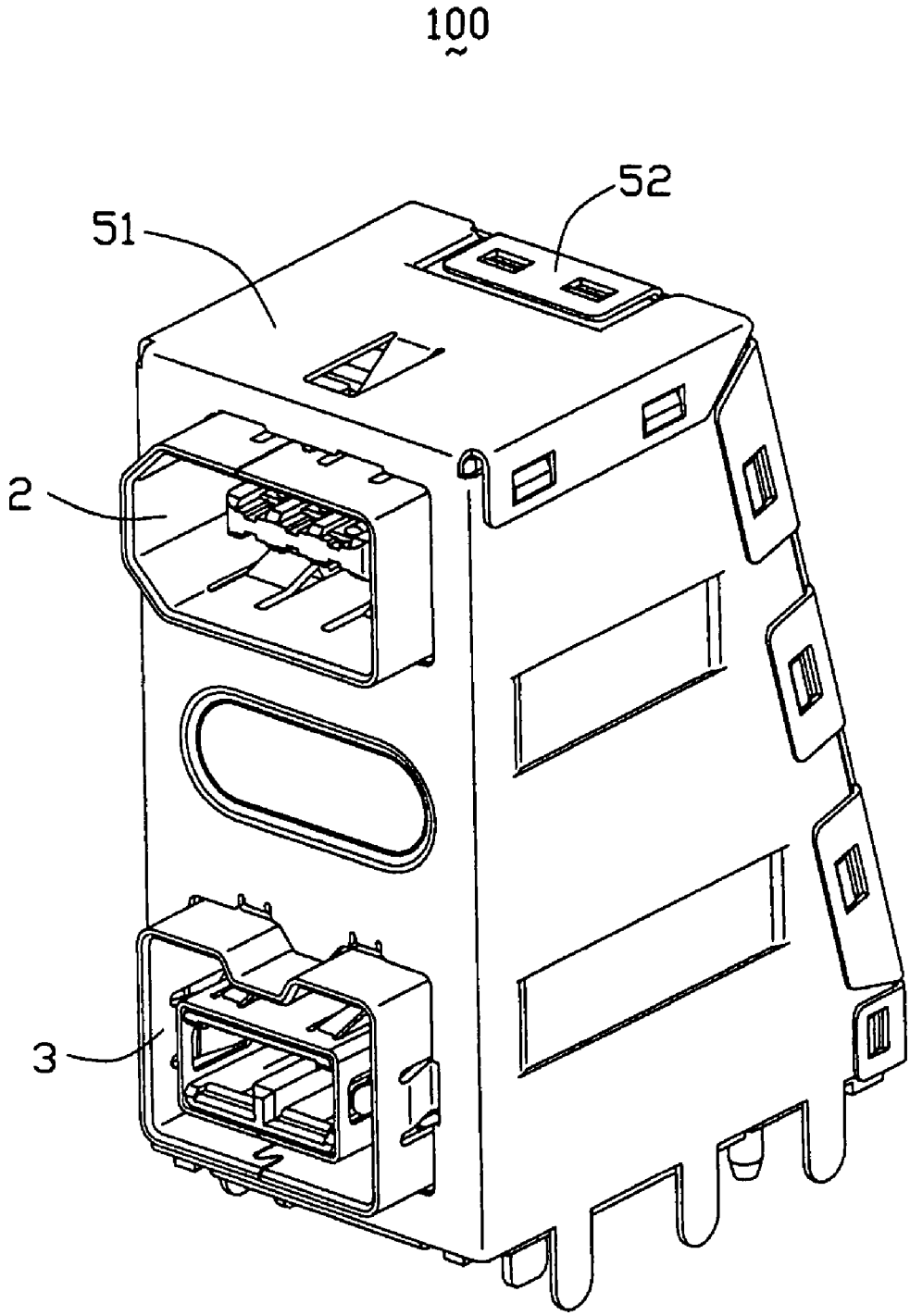
FIG. 1 is a front, perspective view of an electrical connector assembly according to an embodiment of the present invention.
Figure 2:
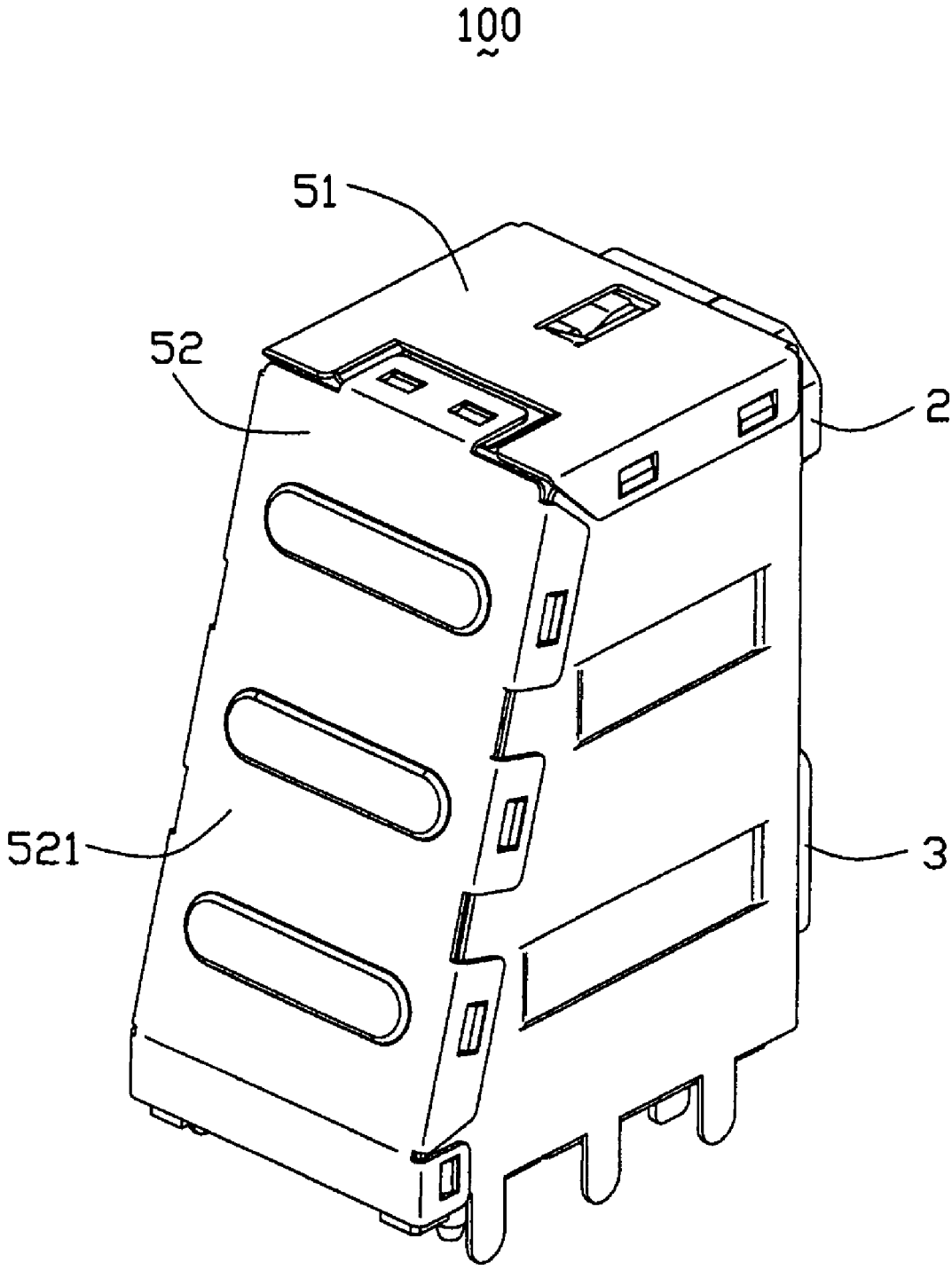
FIG. 2 is similar to FIG. 1, but viewed from another aspect.
Figure 3:
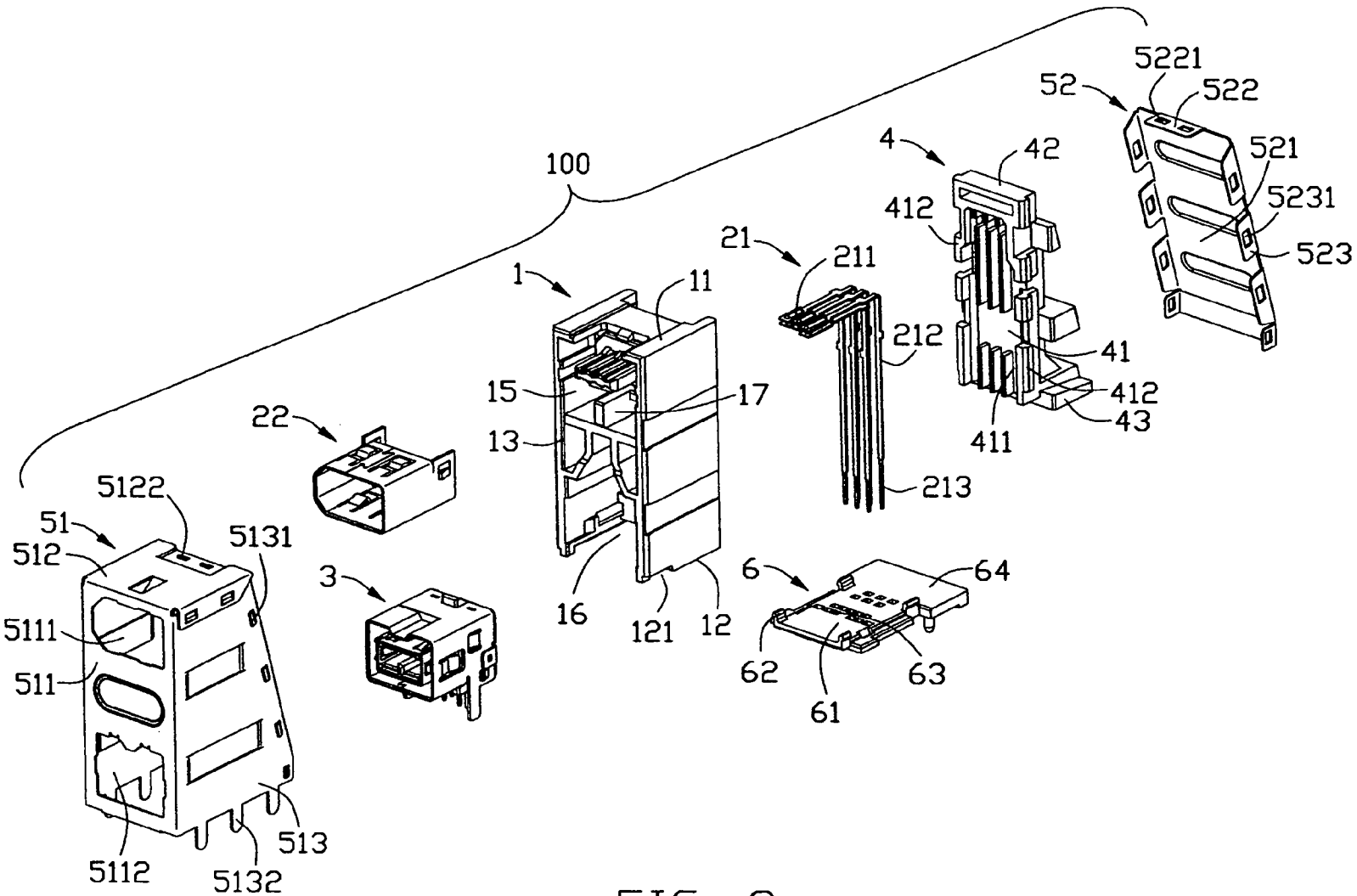
FIG. 3 is an exploded view of the electrical connector assembly shown in FIG. 1.

Referring to FIGS. 1 to 3, an electrical connector assembly 100 mounted on a PCB (not shown) for mating with corresponding plugs (not shown) comprises an insulative housing 1, a first connector component 2, a second connector component 3 stacked vertically below the first connector component 2, a holder 4 fixed to the insulative housing 1, a peripheral metal shield 5 enclosing the insulative housing 1 and a spacer 6 attached to a mounting wall 12 positioned at bottom of the insulative housing 1.

The insulative housing 1 is generally cuboid shaped and includes a top wall 11 opposite to the mounting wall 12, a front wall 13 perpendicular to the top and mounting walls 11, 12, and a rear wall 14 opposite to the front wall 13. A pair of first and second receiving cavities 15, 16 are defined in the front wall 13 for respectively receiving the first and the second connector components 2, 3 therein. The insulative housing 1 comprises a tongue plate 151 horizontally extending forwardly into the first receiving cavity 15 with a plurality of passageways 152 recessed in a top and a bottom faces thereof. The insulative housing 1 has a supporting block 17 extending into the first receiving cavity 15 for abutting against the first connector component 2. The rear wall 14 comprises a plurality of vertical flanges 141 and a plurality of vertical slots 142 formed by the vertical flanges 141, wherein each slot 142 is in communication with the corresponding passageways 152. The rear wall 14 further comprises a concavity 144 and a plurality of engaging apertures 143 disposed on opposite lateral sides thereof. The concavity 144 and the engaging apertures 143 communicate with each other for fitting with the holder 4.

The first connector component 2 comprises a plurality of first contacts 21 retained in the tongue plate 151 and a metal shell 22 received in the first receiving cavity 15 to enclose the tongue plate 151. Each of the first contacts 21 comprises a contact portion 211 received in the passageways 152 and a right-angle bent tail 213 received in the slots 142 of the rear wall 14 in a staggered manner. The supporting block 17 abuts against the metal shell 22 to provide enough engaging force so that the metal shell 22 can be stably retained in the first receiving cavity 15. The first connector component 2 together with the tongue plate 151 forms a first connector which is a standard A-type IEEE-1394 (Institute of Electrical and Electronics Engineers) connector in the preferred embodiment. The second connector component 3 in the preferred embodiment is a standard B-type IEEE-1394 connector. So the detailed description of the first and second components 2, 3 is omitted hereinafter.

Figure 4:
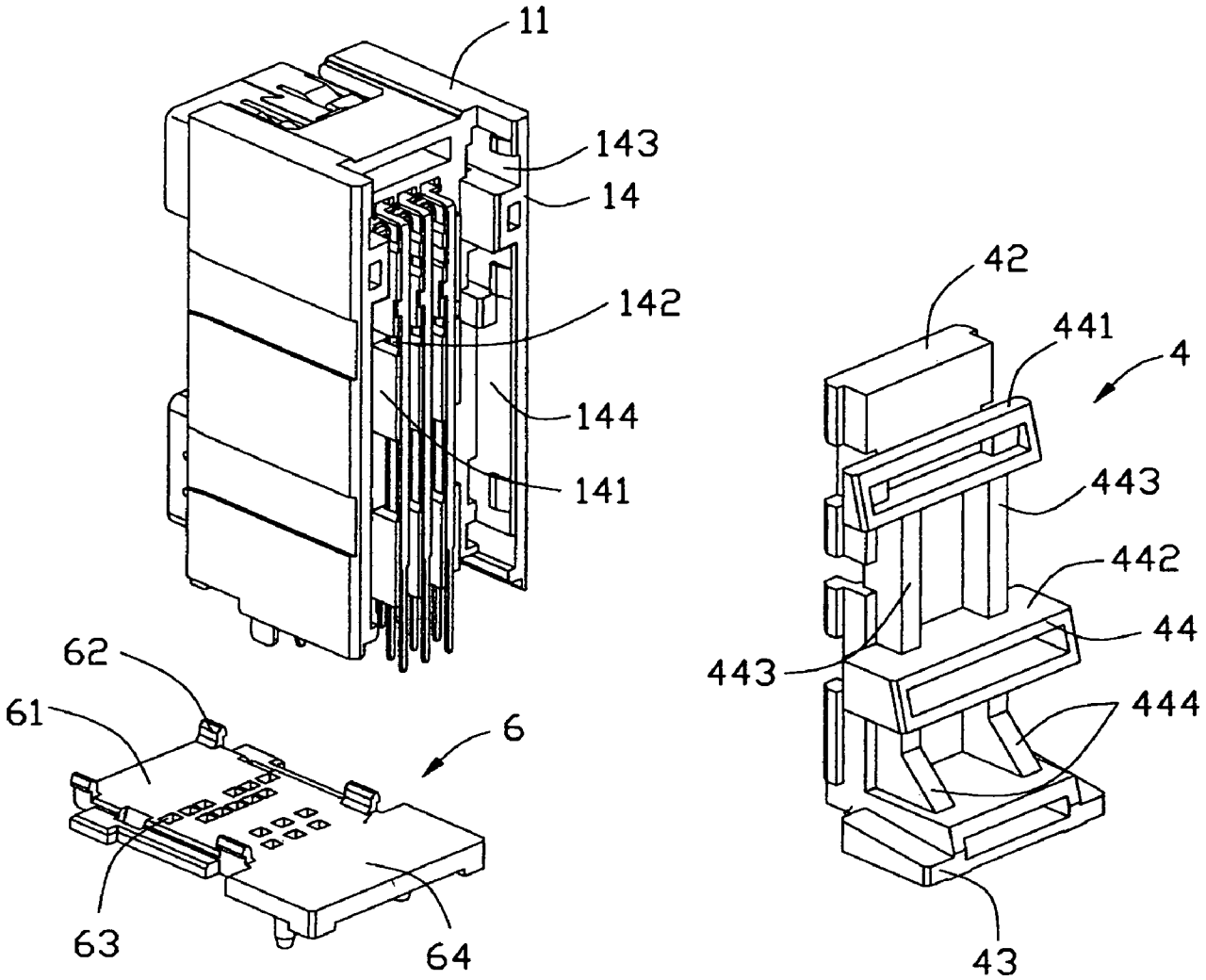
FIG. 4 is a perspective view of the electrical connector assembly prior to assembly of peripheral metal shield, showing a holder and a spacer disconnected to an insulative housing.
Figure 5:
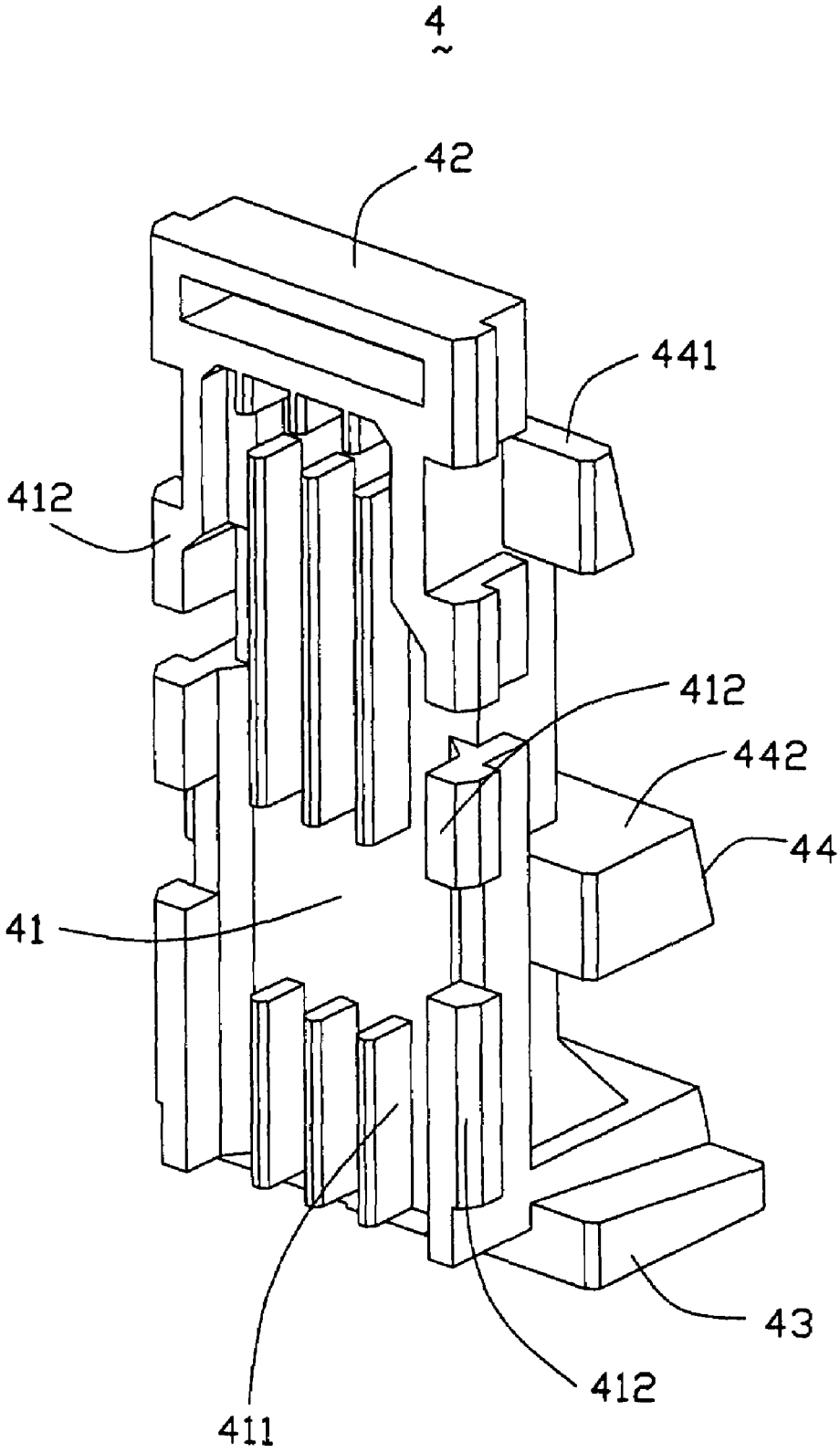
FIG. 5 is an enlarged, perspective view of the holder.

Referring to FIGS. 3 to 5, the holder 4 comprises a vertical mating portion 41, a top and a bottom portions 42, 43 respectively extending backwardly from upper and lower edges of the mating portion 41, and a slant rear portion 44 opposite to the mating portion 41. The top and bottom portions 42, 43 extend in a horizontal direction perpendicularly to the mating portion 41, wherein the top portion 42 extends shorter than the bottom portion 43. Besides, an area of the top portion 42 is smaller than that of the bottom portion 43. The mating portion 41 includes a plurality of incontinuous protrusions 411 formed on an inner face thereof for resisting the right-angle bent tails 213. A plurality of projections 412 extend outwardly on opposite lateral sides of the mating portion 41. The rear portion 44 comprises a first and a second projecting blocks 441, 442 between the top and bottom portions 42, 43. A plurality of enforced portions 443 are disposed connecting the first and the second projecting blocks 441, 442. A pair of connecting blocks 444 are positioned connecting the second block 442 and the bottom portion 43. Each of the first and the second projecting blocks 441, 442 has an inclined face (not labeled) for mating with the peripheral metal shield 5.

In assembly, the holder 4 is assembled to the rear wall 14 of the insulative housing 1. The mating portion 41 is received in the concavity 144 with the projections 412 retained in the corresponding engaging apertures 143 to restrain movement in a front-to-back direction. The vertical protrusions 411 are received in the slots 142 of the insulative housing 1 for abutting against complementary right-angle bent tails 213. Thus, the right-angle bent tails 213 are snugly sandwiched between the insulative housing 1 and the holder 4. An area of the top portion 42 and the top wall 11 is smaller than that of the bottom portion 43 and the mounting wall 12 so that the insulative housing and the holder 4 can be stably mounted on the PCB for mating with corresponding plugs.

The peripheral metal shield 5 includes a front shield 51 and a slant rear shield 52 fixed to the front shield 51. The front shield 51 comprises a mating wall 511 along the front wall 13 of the insulative housing 1, a pair of trapezia shaped side walls 513 backwardly extending from lateral edges of the mating wall 511 and a top wall 512 backwardly extending from a top edge of the mating wall 511. The mating wall 511 defines a pair of first and second openings 5111, 5112 for the first and second components 2, 3 exposed therethrough. The top wall 512 defines a pair of first outstandings 5122 formed at a free end thereof. Each side wall 513 has an upper edge shorter than a lower edge and defines a plurality of second outstandings 5131 thereof. A plurality of grounding legs 5132 extend downwardly from the lower edge of each side wall 513 for initial board retention. The rear shield 52 comprises a main portion 521, a top flap 522 extending forwardly from a top edge of the main portion 521 and a pair of incontinuous side flaps 523. The top flap 522 defines a pair of first holes 5221 for receiving the first outsandings 5122. Each side flap 523 defines a plurality of second holes 5231 for mating with the second outstandings 5231. The rear shield 52 abuts against the rear portion 44 of the holder 4 to further ensure a reliable connection between the insulative housing 1 and the holder 4.

The spacer 6 is attached to both the mounting wall 12 and the bottom portion 43 of the holder 4. The spacer 6 comprises a body 61 and a rear tail 64 integrally connecting with the body 61. The body 61 comprises a plurality of arms 62 extending upwardly for locking with plural depressions 121 of the mounting wall 12 and a plurality of through holes 63 for the right-angle bent tails 213 extending therethrough. The body 61 comprises a front edge (not labeled) reaching the front wall 13 of the insulative housing 1. The rear tail 64 reaches a rear of the bottom portion 43 of the holder 4.

In use, the spacer 6 is mounted on the PCB. When the corresponding plug is inserted or pulled out from the electrical connector assembly 100, the rear tail 64 of the spacer 6 abuts against the PCB and the bottom portion 43, thereby providing stable retaining force to prevent the electrical connector assembly 100 from inclining. As a result, the mating characteristic of the electrical connector assembly is improved.

It is easy to be understood that the electrical connector assembly 100 may not set the spacer 6. In that case, the bottom portion 43 of the holder 4 can be disposed coplanar with the mounting wall 12 of the insulative housing 1. The bottom portion 43 as well as the mounting wall 12 is mounted on the PCB. When the corresponding plug is inserted or pulled out from the first and second connector components 2, 3, the bottom portion 43 extending beyond the insulative housing 1 can abut against the PCB to provide enough retaining force for prevent the electrical connector assembly 100 from inclining. It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly, comprising:

an insulative housing defining a first receiving cavity, a second receiving cavity below the first receiving cavity in a front wall thereof, and a rear wall opposite to the front wall;

a first and a second connector components received in the first and second receiving cavities, respectively;

a holder comprising a mating portion fixed to the rear wall of the insulative housing, a top and a bottom portions respectively extending backwardly from an upper and a lower edges of the mating portion, the top and bottom portions being parallel to each other and perpendicular to the mating portion, the bottom portion extending beyond the rear wall of the insulative housing and being longer than the top portion; and a metallic shell comprising a rear slanted plane covering a rear portion of the holder, the rear portion being opposite to he mating portion.

2. The electrical connector assembly according to claim 1, wherein an area of the top portion is smaller than that of the bottom portion.

3. The electrical connector assembly according to claim 1, wherein the rear wall comprises a plurality of flanges and a plurality of slots formed by the flanges, the first connector component comprising a plurality of contacts with plural right-angle bent tails received in the slots, the mating portion comprising a plurality of protrusions formed on an inner face thereof, the protrusions being received in the slots to abut against the right-angle bent tails.

4. The electrical connector assembly according to claim 1, wherein the rear portion is slanted and comprises a projecting block located between the top and bottom portions, and a connecting block connecting the projecting block and the bottom portion.

5. The electrical connector assembly according to claim 1, wherein the first and second components are standard A-type IEEE-1394 connector and standard B-type IEEE-1394 connector, respectively.

6. The electrical connector assembly according to claim 1, further comprising a spacer attached to a mounting wall of the insulative housing and the bottom portion, the spacer comprising a front edge reaching the front wall and a rear tail reaching a back of the bottom portion.

7. The electrical connector assembly according to claim 1, wherein the rear wall of the insulative housing defines a concavity therein to receive the mating portion of the holder.

8. The electrical connector assembly according to claim 7, wherein the mating portion comprises a projection extending outwardly on a lateral side thereof, the rear wall defining an engaging aperture communicating with the concavity to receive the projection.

9. The electrical connector assembly according to claim 1, further comprising a front metal shield enclosing the insulative housing, the front metal shield comprising a mating wall and a pair of side walls extending from lateral edges of the mating wall, a top edge of each side wall being shorter than a bottom edge thereof from a side view.

10. The electrical connector assembly according to claim 9, wherein the front metal shield defines a pair of through openings corresponding to the first and second connector components, and wherein the first and second connector components extending beyond the mating wall.

11. The electrical connector assembly according to claim 9, wherein the metallic shell is fixed to the front metal shield, the rear portion of the holder being slanted and abutting against the rear slanted plane of the metallic shell.

12. An electrical connector assembly, comprising:

an insulative housing defining a first receiving cavity, a second receiving cavity below the first receiving cavity in a front wall thereof, and a rear wall opposite to the front wall;

a first and a second connector components received in the first and second receiving cavities, respectively;

a holder comprising a mating portion fixed to rear wall of the insulative housing, a top and a bottom portions extending backwardly from the mating portion, an area of the top portion being smaller than that of the bottom portion; and a metal shield enclosing the insulative housing, the metal shield comprising a mating wall mating with the front wall of the insulative housing and a pair of side walls perpendicular to the mating wall, and a top edge of each side wall being shorter than a bottom edge thereof.

13. The electrical connector assembly according to claim 12, wherein the insulative housing comprises a top wall connecting the front and rear walls, and a mounting wall opposite to the top wall, and wherein an area of the top portion and the top wall is smaller than that of the bottom portion and the mounting wall.

14. The electrical connector assembly according to claim 13, further comprising a spacer attached to the mounting wall of the insulative housing and the bottom portion, the spacer comprising a front edge reaching the front wall and a rear tail reaching a back of the bottom portion.

15. An electrical connector comprising:

an insulative housing defining at least one upper level and one lower level;

two connector ports formed at said upper level and said lower level, respectively;

a plurality of terminals respectively disposed in said connector ports; and a metallic shell enclosing said housing at least on a top face, two side faces and a front face wherein there are at least two openings in the metallic shell in alignment with the corresponding connection ports; wherein the metallic shell defines a trapezoidal configuration with a shorter upper side and a longer bottom side from a side view, having a front vertical plane covering a front face of the housing, and a rear slanted plane covering a rear side of the housing.

16. The electrical connector as claimed in claim 15, wherein a holder is located between the rear slanted plane and a rear face of the housing.

17. The electrical connector as claimed in claim 16, wherein said holder defines a shorter upper side and a longer bottom side with a vertical side therebetween, from a side view.

18. The electrical connector as claimed in claim 17, wherein the holder is of an L-shaped configuration.

19. The electrical connector as claimed in claim 18, wherein all terminals are terminated in front of said holder.

* * * * *